US007325676B2

(12) United States Patent
Galaz Rodriguez

(10) Patent No.: US 7,325,676 B2
(45) Date of Patent: Feb. 5, 2008

(54) CONTAINER FOR CONTAINING TWO DIFFERENT SEPARATE PRODUCTS AND MIXING THEM

(76) Inventor: Jose Luis Galaz Rodriguez, C/ San Juan, N° 30 1° lzda, 09007 Burgos (ES)

( * ) Notice: Subject to any disclaimer, the term of this patent is extended or adjusted under 35 U.S.C. 154(b) by 20 days.

(21) Appl. No.: 10/890,557

(22) Filed: Jul. 12, 2004

(65) Prior Publication Data

US 2005/0016875 A1 Jan. 27, 2005

(30) Foreign Application Priority Data

Jul. 11, 2003 (EP) ..... 03380171

(51) Int. Cl.
*B65D 25/08* (2006.01)
*B65D 51/22* (2006.01)

(52) U.S. Cl. ..... 206/219; 206/222; 220/254.1

(58) Field of Classification Search ..... 206/219, 206/221–222, 807; 215/251–256, 12.2, DIG. 8; 220/254.1, 254.7
See application file for complete search history.

(56) References Cited

U.S. PATENT DOCUMENTS 3,088,830 A * 5/1963 Graham ..... 206/807
3,156,369 A * 11/1964 Bowes et al. ..... 206/222
3,603,469 A * 9/1971 Magni ..... 206/222
4,000,839 A * 1/1977 Tecco et al. ..... 220/254.7
4,591,050 A * 5/1986 Finke et al. ..... 206/222
4,615,437 A * 10/1986 Finke et al. ..... 206/222
4,793,475 A * 12/1988 Itzel ..... 206/221
5,029,718 A * 7/1991 Rizzardi ..... 206/222
5,038,951 A * 8/1991 Rizzardi ..... 206/222
5,495,944 A * 3/1996 Lermer ..... 206/807
5,811,060 A * 9/1998 Laguna Valderrama ..... 206/222
6,116,445 A * 9/2000 Ikemori et al. ..... 215/301
6,148,996 A * 11/2000 Morini ..... 206/222
6,705,462 B2 * 3/2004 Kasuya ..... 206/222
2005/0161348 A1 * 7/2005 Morini ..... 206/219

* cited by examiner

*Primary Examiner*—Bryon P. Gehman
(74) *Attorney, Agent, or Firm*—Ostrolenk, Faber, Gerb & Soffen, LLP

(57) ABSTRACT

A container for containing two different separate products and mixing them, comprising a recipient for a first product, a capsule for containing a second product, and a closure cap which includes an outer skirt with a threaded tamper-evident ring and a coaxial inner skirt having an edge which breaks the bottom of the capsule. The cap is provided in its upper base with an opening, which can be closed by means of a detachable cover. Once the assembly is assembled and closed, it is surrounded by an easily breakable, laminar tamper-evident cover.

8 Claims, 3 Drawing Sheets

CONTAINER FOR CONTAINING TWO DIFFERENT SEPARATE PRODUCTS AND MIXING THEM

BACKGROUND OF THE INVENTION

The present invention refers to a container for containing two different separate products and mixing them, by means of which the two products can be kept separate for an indefinite time period without the risk of them coming into contact with each other, and they can be mixed inside of the container in the moment they are to be used.

Containers of the type explained are widely used in the chemical-pharmaceutical industry, for example, for the distribution and sale of certain medicines including two products of substances which must be kept separate until taking them.

Containers are already known for the mentioned purpose which comprise a recipient with a loading opening, which contains a first product; a capsule containing a second product, which is coupled on the recipient as from its loading opening; and a closure cap of the recipient, which is provided with means for breaking the bottom of the capsule, such that the second product contained in said capsule falls into the recipient containing the first product, being able to then obtain a good mixture of the two products, for example, by means of shaking the container.

A container of this type is disclosed, for example, in Spanish Utility Model number 147,793, dated 23 Apr. 1969, regarding a storage and closure cap on necks of containers. According to said Utility Model, a capsule open on its upper base and closed on the lower one is internally coupled on the neck of a recipient. Inside of this capsule, a second breaker capsule is arranged, which is similar to the first one but arranged in a reverse position, this second breaker capsule having the wall finished off with an inclined edge which faces the bottom of the first capsule and separated therefrom by means of an easily detachable upper ring. The assembly is closed by means of a cap with a skirt that can be screwed to the neck of the container. With this constitution, two different products, a first product contained in the container or recipient and a second product contained in said first capsule, can be kept separate until the moment of their use. For the mixing thereof, it is enough to separate the upper ring and then screw on the cap to a maximum screwed-on position in which it pushes the second breaker downwards, such that the inclined edge of the wall thereof acts on and breaks the bottom of the first capsule, so that the product contained therein falls into the recipient or container, then bringing together the two products so as to carry out their mixing by shaking.

In the disclosed cap, in order to carry out the mixing, it is necessary to remove the cap, remove the upper ring and screw the cap back on.

This drawback is resolved by making the cap and second capsule form a single part, as disclosed, for example, in European Patent EP 0963325. In said patent, the breaker capsule is coupled to the bottom of the cap by means of an intermediate wall. Furthermore, when the cap is screwed on to maximum screwed-on position, the edge of the wall of the container capsule is retained between the skirt of the cap and the wall of the breaker capsule, such that when unscrewing said cap, the removal of the container capsule occurs. This possibility demands a special configuration of the edge of the container capsule and a good fit of said edge between the skirt of the cap and the wall of the breaker capsule, so as to ensure removal of the container capsule. As is normal in this type of closures, the wall or skirt of the cap is provided with a tamper-evident ring, breaking of which occurs when initiating the screwing on of the cap from the closure position until maximum screwed-on position. This ring serves to limit the screwing-on of the cap in its normal closure position, keeping the edge of the wall of the breaker capsule close to the bottom of the container capsule, and, as a tamper-evident ring, against undue manipulations. This tamper-evident ring system is widely used in closure of caps of similar bottles and containers.

In either of the explained cases, it is necessary to completely unscrew the cap until opening the container for taking or using the mixture of the two products.

SUMMARY OF THE INVENTION

The object of the present invention is to eliminate the aforementioned drawbacks by means of a container of the type explained in which, for taking or removing the mixture, it is not necessary to unscrew the cap, but rather taking or emptying the content can be done with the cap fixed on the neck of the recipient, in its maximum screwed-on position.

Another object of the invention is to simplify the constitution of the breaker cap-capsule assembly, as said capsule is substituted by a skirt or wall which internally projects from the bottom of the cap, in a coaxial position to the outer threaded skirt or wall, forming part of said cap.

A further object of the invention is to provide the container with an additional tamper-evident seal, which provides complete security against undue manipulations.

The container of the invention is of the type explained, constituted by a recipient provided with a filling opening and intended for containing a first product, by a capsule containing a second product, which is open on its upper base, closed on the lower base and coupled on the recipient as from its opening; and by a closure cap of the recipient which includes an outer skirt with a thread and tamper-evident ring.

According to the invention, the closure cap is provided with an inner coaxial skirt, as from the edge, which has a free inclined end and which can be supported by this edge and break the bottom of the capsule when screwing on the cap from a closed position to a maximum screwed-on position.

This constitution implies a considerable simplification in the manufacture of the cap, since the breaker capsule is substituted by a simple inner skirt forming part of the cap and which projects from the inner surface of the bottom thereof.

According to another feature of the invention, the closure cap is provided on the bottom with an opening coinciding with the contour defined by the inner skirt, which opening is closed by means of a detachable cover. This constitution permits that emptying the content of the container, after carrying out the mixture, can be carried out with no need of unscrewing the cap, it being enough to remove the cover closing the opening of the bottom of said cap, through which the content of the container comes out.

According to another additional feature of the invention, both the recipient and cap are tightly surrounded by an easily breakable laminar tamper-evident cover, which partially envelopes the bottom of the recipient and the cover fixed to the cap, such that it ensures no manipulation of the content, thus providing additional security, not only against separation of the cover, but also against the unscrewing of the cap. This laminar cover can be constituted of a thermo-retractable sheet, which can be of a transparent nature, such that it permits seeing through it the print which the surface of the container or label thereof may have.

All the features of the invention, included in its claims, are explained below in greater detail with the aid of the attached drawings, which show a non-limiting preferred embodiment.

DESCRIPTION OF A PREFERRED EMBODIMENT

Figure 1:
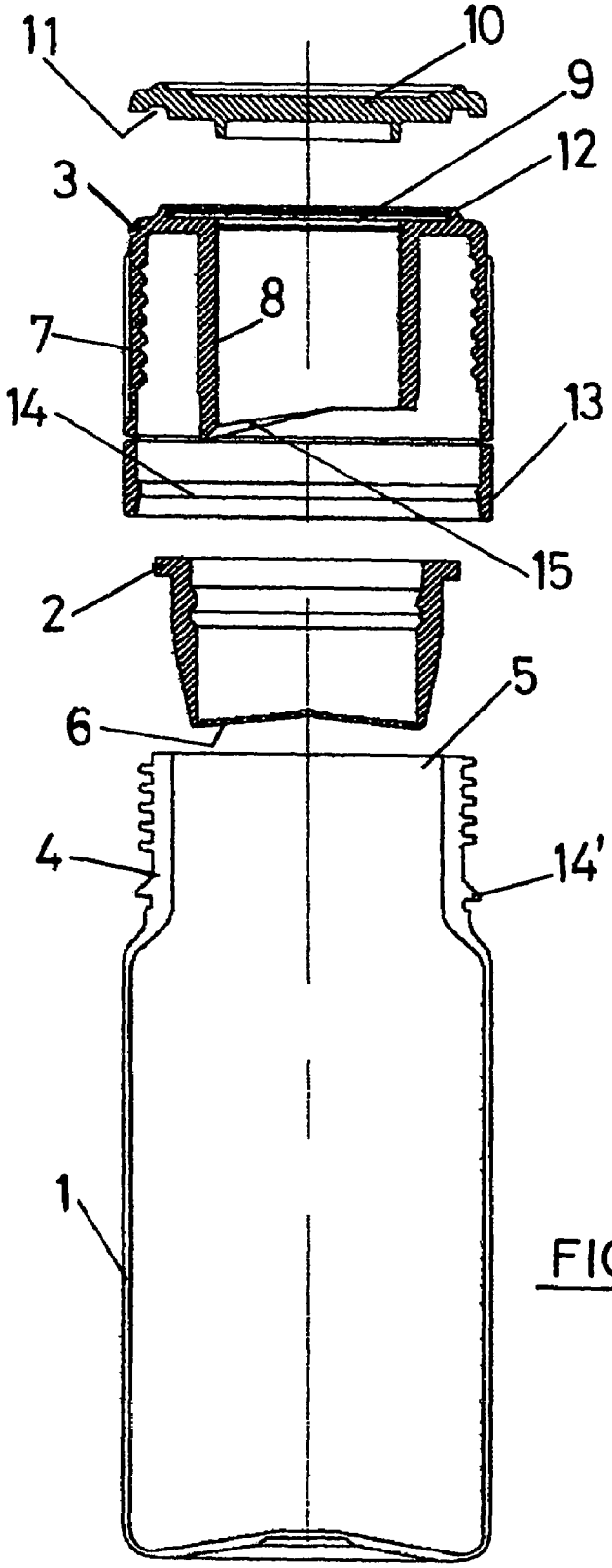
FIG. 1 shows a diametric section of a container constituted according to the invention, in which the different components forming it are separated from each other.

As can be seen in FIG. 1, the container comprises a recipient 1 intended for containing a first product, a capsule 2 intended for containing a second product and a closure cap 3.

The recipient is provided with an externally threaded neck 4 which ends in a loading opening 5. The capsule 2 is dimensioned so as to be tightly coupled inside of the neck 4 of the recipient 1, through the opening 5. This capsule 2 is closed on the bottom 6 and open on the upper base, it being possible to arrange around this open base a peripheral rim for supporting on the edge of the opening 5 of the recipient.

The cap 3 is provided with an outer, internally threaded skirt 7, and an internal skirt 8 coaxial to the outer skirt 7 and which projects from the inner surface of the bottom of the cap. This cap also has a central opening 9 on the top coinciding with the contour defined by the inner skirt 8. This opening 9 is closed by means of an outer cover 10. In order to obtain a secure fitting of the cover 10 on the top of the cap 3, said cover can have on its inner surface an annular groove 11 in which a facing annular rib 12 projecting from the outer surface of the top of the cap 3 tightly fits.

The outer skirt 7 of the cap 3 is provided on the lower part with a tamper-evident ring 13, having a known constitution and function, which is coupled to the skirt by means of easily breakable bridging pieces. This ring is provided with an inner rib 14 capable of being supported or retained by a rib 14' projecting from the lower part of the neck 4 of the recipient 1.

The inner skirt 8 of the cap 3 is provided with an inclined lower edge 15, having a cutting profile, for the purpose that will be explained below.

Figure 2:
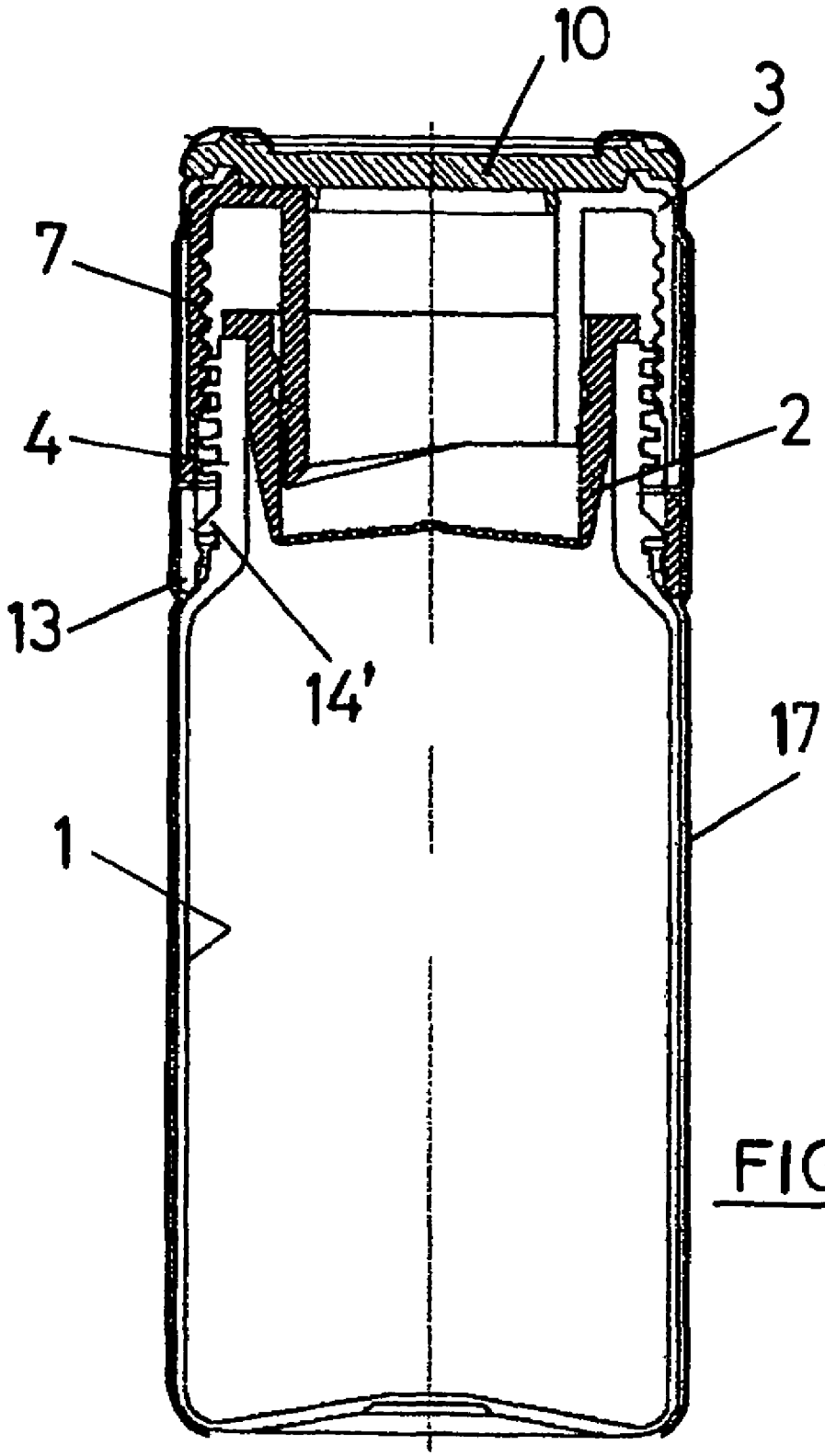
FIG. 2 shows a view similar to FIG. 1, with the different components being assembled, for keeping two products separated, and with the laminar tamper-evident cover.

With said constitution, as can be seen in FIG. 2, for closure of the recipient, the capsule 2 is tightly arranged inside of the neck 4 of the recipient 1. For its part, the cover 3 is fixed by means of screwing of the skirt 7 in the thread of the neck 4 of the recipient 1, the inner rib 14 of the tamper-evident ring being below the outer rib 14' of the neck of the recipient. The cover 10 is fixed to the top of the cap 3, such that the rib 12 of the bottom of said cap is introduced into the annular groove 11 of the cover. In this situation, the lower edge 15 of the inner skirt 8 is separated from the bottom of the capsule 2, this position corresponding to that of the storage or packaging of the product. Lastly, the recipient assembly is closed by means of a laminar cover 17, for example based on thermo-retractable material, which can be of a transparent nature. This cover partially covers the bottom of the recipient 1 and the cover 10, thus providing complete security against the separation of any of the elements or components of the container.

When wishing to open the container for the use of the products contained therein, the outer laminar cover 17 is broken and separated. Then, the cap 3 is screwed on from the position shown in FIG. 2 to a maximum screwed-on position shown in FIG. 3. This operation can be done directly, since the tamper-evident ring 18, when pressed against the area of the container 1 with the biggest width, will cause its breaking, permitting the screwing on of the cap. Another possibility is to initially carry out a slight unscrewing of the cap, an operation in which the ring 13 is retained by the support of the inner rib 14 of this ring against the outer rib 14' of the neck of the recipient 1.

Figure 3:
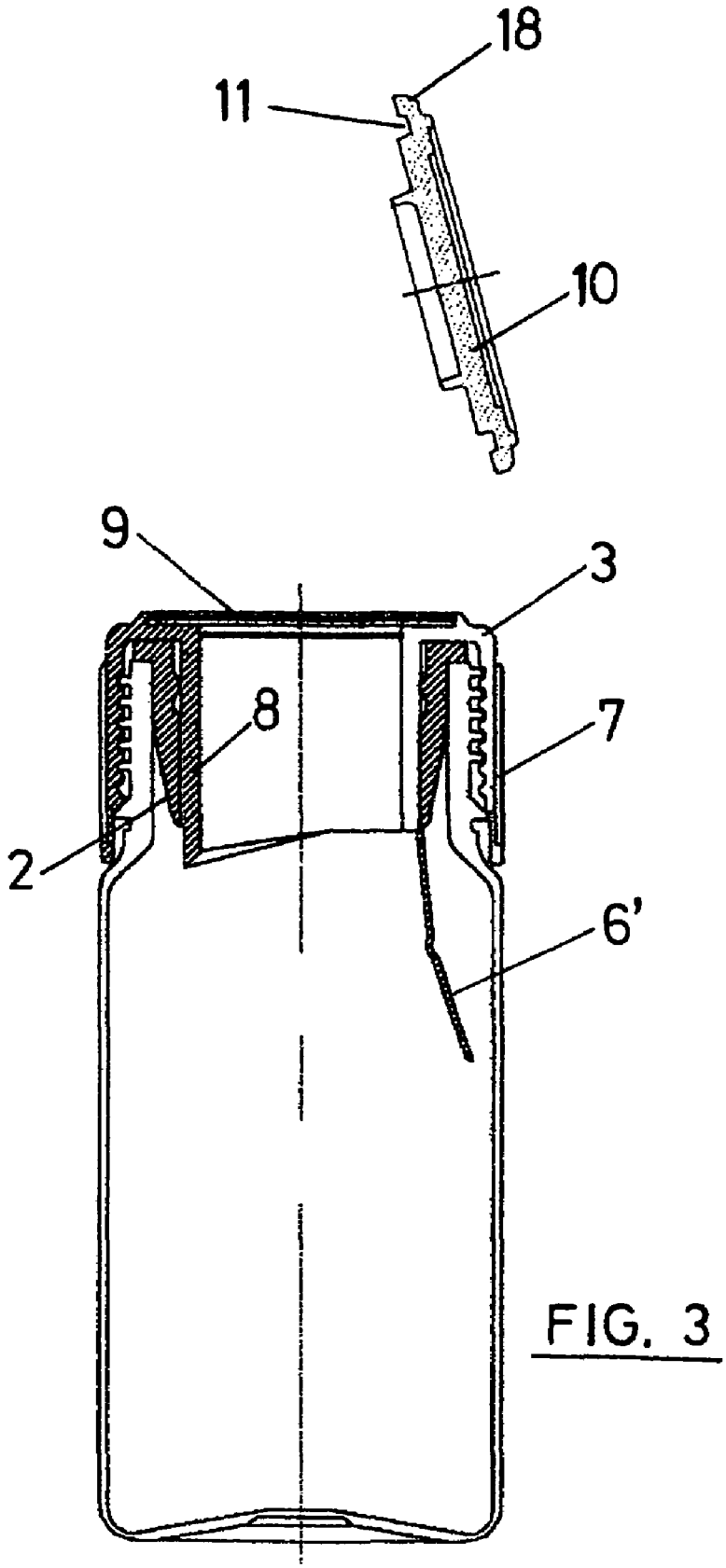
FIG. 3 shows a view similar to FIG. 2 once the container is open for the removal of the mixture of the two products.

In any case, the cap 3 reaches the maximum screwed-on position shown in FIG. 3, in which the skirt 8, through the lower cutting edge 15, has broken the bottom 6 of the capsule 2 and pushes it to position 6' of FIG. 3, in which the product contained in this capsule has completely fallen to the bottom of the recipient 1, coming together with the product contained by said recipient, being able to achieve a perfect mixture of both products, for example, by means of shaking.

For the extraction or ingestion of the content, it will be enough to separate the cover 10, an operation which is facilitated by means of the peripheral rim 18 of said cover. The outflow of the product will be done through the inner skirt 8 and the opening 9, with no need of unscrewing the cap 3 and removing the capsule 2.

In summary, with the container of the invention, the constitution of the cap 3 is simplified, a more comfortable removal or pouring of the mixture is provided and complete security against manipulation is provided due to the existence of the outer cover 17 and the tamper-evident ring 13.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A container having two separate storage areas, comprising a recipient container having a filling opening and a cap attachment region located down on the recipient container from the filling opening;

a container capsule having an upper base which is open and having a lower base which is spaced below the upper base and which is closed, the container capsule being disposed at the recipient container with the upper base at the filling opening;

a closure cap for the recipient container, the closure cap including an outer skirt shaped to engage with the cap attachment region of the recipient container;

a tamper-evident ring on a lower part of the outer skirt and extending along the recipient container;

an inner skirt in the closure cap and inward in the closure cap from the outer skirt, the closure cap having a top, the top being so defined when the closure cap is disposed as part of the container, from which top the outer and inner skirts depend, the inner skirt having a free bottom edge extending into the container capsule and extending toward the lower base of the container capsule, the free bottom edge of the inner skirt being so positioned, so shaped, and of such material that when the closure cap is moved onto the recipient container, the outer and inner skirts are moved down toward the recipient container, until the free bottom edge of the inner skirt contacts and breaks through the lower base of the container capsule; the top of the closure cap having an opening coinciding with a contour defined by the inner skirt; and a detachable cover applied over the opening in the top of the closure cap, the detachable cover being completely discrete and detachable from the closure cap, the detachable cover covering the entire top of the closure cap when the detachable cover is applied over the opening in the top of the closure cap.

2. The container of claim 1, wherein the region of the recipient container down from the opening thereof is externally threaded and the outer skirt of the closure cap is cooperatingly correspondingly internally threaded to the threading on the recipient container so that the closure cap is threadedly attached and threadedly moved along the container.

3. The container of claim 1, wherein the inner skirt is coaxial with the outer skirt.

4. The container of claim 1, further comprising an additional breakable, laminar, tamper-evident cover partially enveloping the bottom of the recipient container, the detachable cover is fixed to the closure cap and surrounds the recipient container and the closure cap.

5. The container of claim 1, wherein the top of the closure cap has an upper surface on which the detachable cover is placed, the upper surface coupling the outer skirt and the inner skirt;

the upper surface and the detachable cover have respective facing surfaces and respective facing and supporting elements on their facing surfaces, and the facing and supporting elements being separable upon the detachable cover being detached from the closure cap.

6. The container of claim 5, wherein the fixing and supporting elements comprise an annular rib projecting from the upper surface; the detachable cover having an annular groove therein positioned to face and be fixed by snapping the annular groove of the detachable cover on the annular rib.

7. The container of claim 1, wherein the tamper-evident ring on the outer skirt is positioned on the recipient container and the recipient container is so shaped that upon movement of the closure cap onto the recipient container, the tamper-evident ring is urged to break off the skirt by contact of the tamper-evident ring with the recipient container.

8. The container of claim 1, wherein the recipient container is adapted for holding a first product, the capsule is adapted for holding a second product and upon the base of the capsule being open, the products in the recipient container and the capsule are adapted to come together and be mixed, and the opening in the base of the closure cap enabling exit of mixed items from the recipient container through the inner skirt and out the opening in the base of the closure cap.

* * * * *